US008496064B2

(12) United States Patent
Du et al.

(10) Patent No.: US 8,496,064 B2
(45) **Date of Patent: *Jul. 30, 2013**

(54) SYSTEM AND METHOD FOR ENGAGING COMPLETIONS IN A WELLBORE

(75) Inventors: Michael H. Du, Pearland, TX (US); Gary L. Rytlewski, League City, TX (US); William D. Chapman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1017 days.

This patent is subject to a terminal disclaimer.

(21) Appl. No.: 11/850,243

(22) Filed: Sep. 5, 2007

(65) Prior Publication Data

US 2009/0056947 A1 Mar. 5, 2009

(51) Int. Cl.
*E21B 17/02* (2006.01)
*E21B 17/05* (2006.01)
*E21B 17/07* (2006.01)

(52) U.S. Cl.
USPC ..... 166/380; 166/242.6; 166/242.1

(58) Field of Classification Search
USPC ..... 166/242.6, 242.1, 318, 380; 285/101, 285/102, 106, 96, 322
See application file for complete search history.

(56) References Cited

U.S. PATENT DOCUMENTS

| | | | | |
|---|---|---|---|---|
| 2,806,538 | A * | 9/1957 | Conrad | 285/18 |
| 4,347,900 | A * | 9/1982 | Barrington | 166/380 |
| 4,432,417 | A * | 2/1984 | Bowyer | 166/120 |
| 4,601,492 | A * | 7/1986 | George | 285/3 |
| 4,682,848 | A | 7/1987 | Cairns | |
| 5,526,888 | A * | 6/1996 | Gazewood | 175/320 |
| 5,838,857 | A | 11/1998 | Niekrasz | |
| 6,098,716 | A * | 8/2000 | Hromas et al. | 166/377 |
| 6,186,229 | B1 | 2/2001 | Martin | |
| 6,390,193 | B1 | 5/2002 | Martin | |
| 6,772,835 | B2 * | 8/2004 | Rogers et al. | 166/177.4 |
| 6,929,404 | B2 | 8/2005 | Jones | |
| 6,983,796 | B2 | 1/2006 | Bayne | |
| 7,186,033 | B2 | 3/2007 | Deans | |
| 2002/0112861 | A1 * | 8/2002 | Restarick et al. | 166/384 |
| 2006/0188202 | A1 | 8/2006 | Deans | |
| 2006/0243454 | A1 | 11/2006 | Bolze | |
| 2007/0144746 | A1 | 6/2007 | Jonas | |

FOREIGN PATENT DOCUMENTS

| | | |
|---|---|---|
| GB | 2409693 | 7/2005 |
| GB | 2413399 | 10/2005 |
| WO | 2005045175 | 5/2005 |

* cited by examiner

*Primary Examiner* — Cathleen Hutchins
(74) *Attorney, Agent, or Firm* — David Groesbeck; Brandon S. Clark

(57) ABSTRACT

A technique is provided for engaging and disengaging an upper completion with a lower completion positioned in a wellbore. The upper completion comprises an upper communication line, and the lower completion comprises a lower communication line. The upper completion is mechanically latched with the lower completion and the communication lines are coupled in a manner that enables selective engagement and disengagement. A communication line union is used to connect the upper communication line and the lower communication line in a plurality of rotational orientations of the upper completion relative to the lower completion.

24 Claims, 6 Drawing Sheets

SYSTEM AND METHOD FOR ENGAGING COMPLETIONS IN A WELLBORE

BACKGROUND

Completion assemblies are used in a variety of well related applications. For example, completion assemblies can be utilized in well treatment and well production applications in oil wells and gas wells. The completion assemblies are deployed downhole into a wellbore and secured at a desired location within the wellbore. In many applications, a given well is completed with two or more completion assemblies.

Various control lines are routed downhole along or through the completion assemblies to enable communication with many types of well tools. If completion assemblies are deployed separately or subsequently disconnected, accommodation must be made for connecting and/or disconnecting the control lines. However, the process of engaging and/or disengaging the mechanical structure of the completion assemblies and the control lines can be difficult. For example, difficulties have arisen in orienting the completion assemblies with respect to each other to enable coupling of control lines. Difficulties also have arisen in providing a system that can be engaged and disengaged in a relatively easy, dependable and repeatable manner.

SUMMARY

In general, the present invention provides a system and method for moving an upper completion into engagement or out of engagement with a lower completion positioned in a wellbore. The upper completion comprises an upper communication line, and the lower completion comprises a lower communication line. During engagement, the upper completion is mechanically latched with the lower completion and the communication lines are coupled. The upper communication line is coupled with the lower communication line via a union that enables communication between the upper and lower communication lines regardless of the rotational orientation of the upper completion relative to the lower completion.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a well completion system that facilitates the engagement and disengagement of completions in a wellbore. Two or more completions with communication lines can be engaged and/or disengaged in a simple, repeatable manner while in a wellbore. The communication line or lines routed along the completions are automatically engaged or disengaged as the completions are mechanically engaged or disengaged, respectively.

In oil and gas wells, the wells can be completed with two or more completion assemblies. Communication lines, such as a hydraulic communication lines, electrical communication lines, and optical communication lines, are connected between completions. The connections allow an upper completion to be disconnected from a lower completion and pulled out of the well without removing the lower completion. Subsequently, the upper completion and the communication lines can be reconnected to the lower completion and communications can resume along the communication lines.

The system and methodology described herein are useful in, for example, both one-trip and two-trip approaches to deployment of completion assemblies. In the one-trip approach, an upper completion and a lower completion are assembled together on the surface and installed into the well during the same trip downhole. When desired, the upper completion can be disconnected from the lower completion and pulled. For the one-trip approach, the connection between the upper completion and the lower completion is designed to handle the tensile load applied by the lower completion during deployment into the wellbore. In the two-trip approach, the upper completion is installed into the well after installation of the lower completion. This allows a well treatment or well treatments, e.g. a gravel pack, to be carried out after installation of the lower completion but prior to installation of the upper completion. The two-trip approach enables use of a connection between completions that does not have as high a load bearing requirement.

Figure 1:
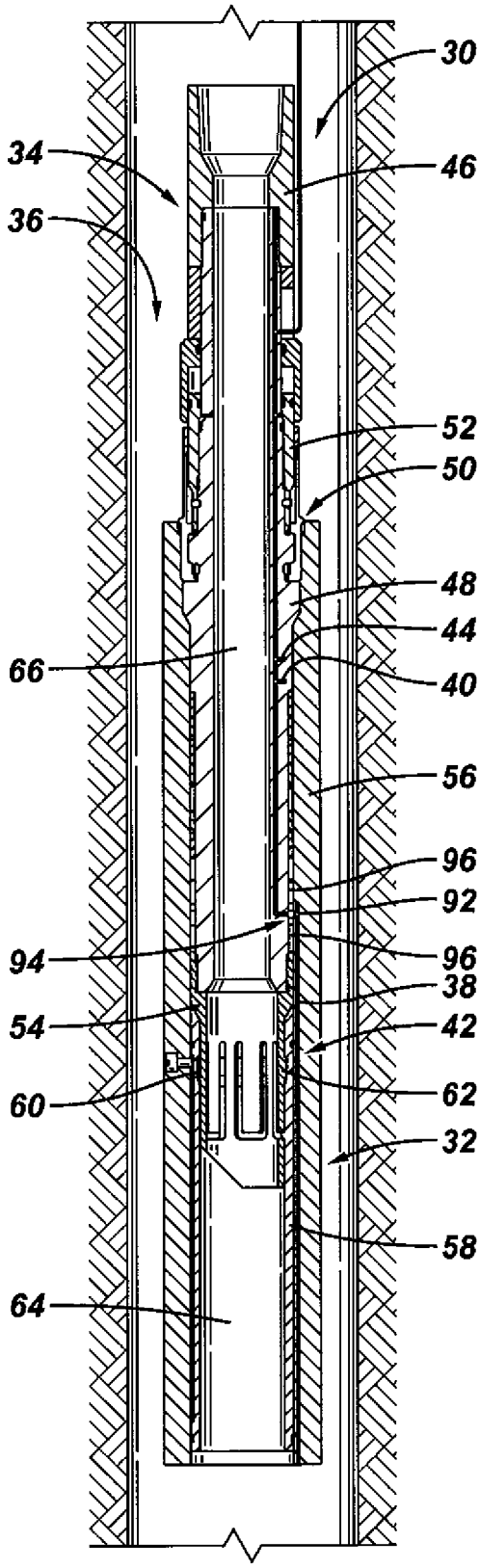
FIG. 1 is a cross-sectional view of a well system having an upper completion assembly and a lower completion assembly deployed in a wellbore, according to an embodiment of the present invention.

Referring generally to FIG. 1, one embodiment of a well system 30 is illustrated. In this embodiment, well system 30 can be utilized in one-trip applications in which a plurality of completion assemblies are assembled on the surface and installed into a wellbore in a single trip downhole. Well system 30 comprises a lower completion 32 that is engaged by an upper completion 34 for deployment in a wellbore 36. Lower completion 32 comprises a lower communication line 38, and upper completion 34 comprises an upper communication line 40. The upper and lower communication lines may comprise hydraulic lines, electrical lines, optical lines or other types of communication lines. In many applications, the lower communication line 38 and the upper communication line 40 comprise enclosed passages 42, 44 formed in the walls of lower completion 32 and upper completion 34 to create flow paths for hydraulic communication and/or passages through which optical fibers, conductors, or other signal carriers are routed. In the case of hydraulic communication lines, the enclosed passages serve to carry hydraulic fluid for conducting communication signals, e.g. pressure signals, uphole and/or downhole.

Upper completion 34 can be selectively moved out of engagement with lower completion 32 and back into engagement with lower completion 32 repeatedly. In the embodiment illustrated, upper completion 34 comprises a top sub 46 connected to an upper completion mandrel 48. Upper completion 34 further comprises a latch mechanism 50 that may be in the form of a collet used to mechanically engage upper completion 34 with lower completion 32. By way of example, collet 50 may comprise a snap latch collet.

A shiftable power sleeve 52 is shiftable between a locked position in which collet 50 is locked in engagement with lower completion 32 and a release position that enables mechanical release of upper completion 34 from lower completion 32. The actuation of shiftable power sleeve 52 is explained in greater detail below. Upper completion 34 also comprises a secondary collet 54 positioned below collet 50. Secondary collet 54 can be used to perform specific actions upon the engagement and/or disengagement of upper completion 34 and lower completion 32. For example, secondary collet 54 can be utilized in shifting components to block access to lower communication line 38 when upper completion 34 is disengaged and moved away from lower completion 32.

For example, lower completion 32 may comprise a lower completion housing 56 having a lower protection sleeve 58 movable to block access to lower communication line 38. In the embodiment illustrated, lower protection sleeve 58 is slidably mounted along an interior of lower completion housing 56. The lower protection sleeve 58 comprises engagement features 60 designed to releasably engage corresponding engagement features 62 of secondary collet 54. Thus, when upper completion 34 is disengaged and pulled upwardly from lower completion 32, secondary collet 54 moves lower protection sleeve 58 upwardly until the sleeve blocks access to lower communication line 38.

When upper completion 34 is engaged with lower completion 32 within wellbore 36, a primary fluid flow, e.g. a production fluid flow, can be established through the completion assemblies. For example, lower completion 32 may comprise a central flow passage 64 that is aligned with a corresponding central flow passage 66 of upper completion 34. Flow passages 64, 66 enable the production of fluid up through well system 30 to a desired collection location and/or down through well system 32 and into the surrounding formation.

Figure 2:
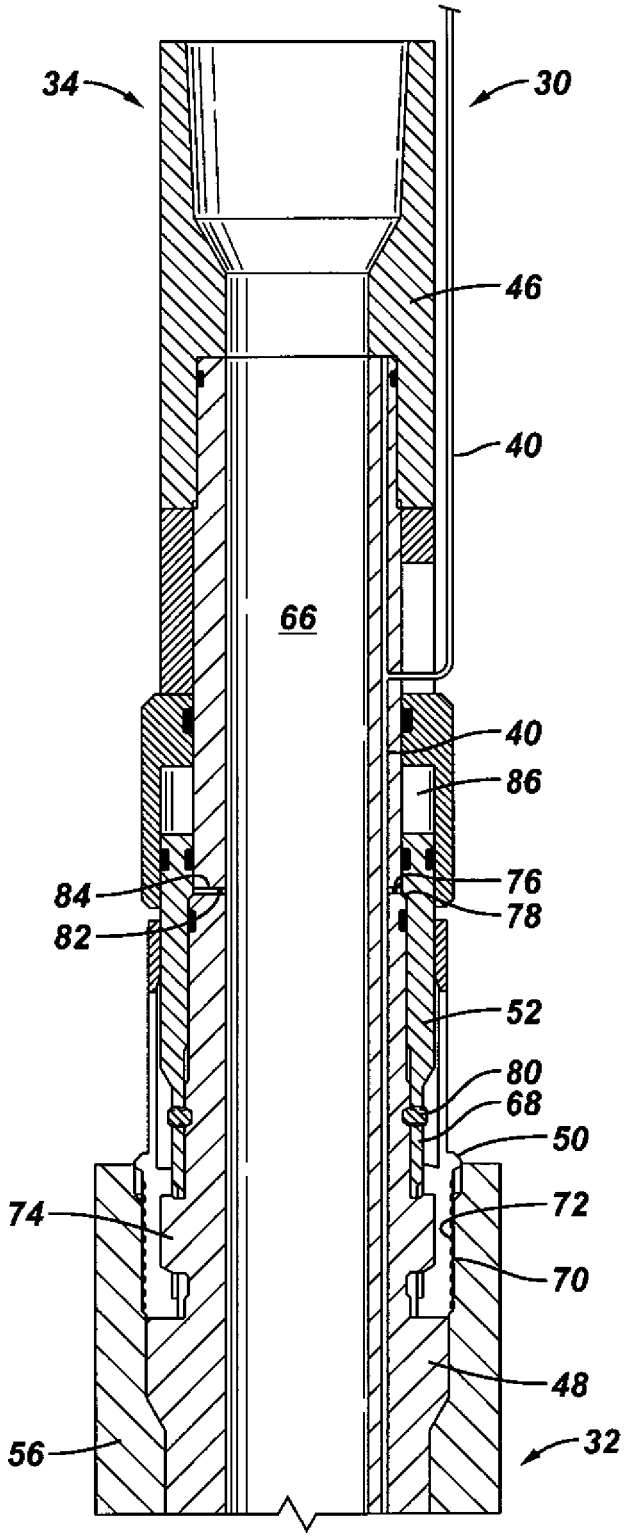
FIG. 2 is an enlarged view of a portion of the well system illustrated in FIG. 1, according to an embodiment of the present invention.

An enlarged view of the upper section of upper completion 34 and lower completion 32 is provided in FIG. 2. As illustrated, shiftable power sleeve 52 is disposed around upper completion mandrel 48 in a locked position. The shiftable power sleeve 52 comprises an extension 68 that slides between collet 50 and upper completion mandrel 48 to lock an engagement region 70 of collet 50 against a corresponding engagement region 72 of lower completion 32 at, for example, an upper portion of lower completion housing 56. The collet 50 is held against rotational movement along upper completion mandrel 48 by an abutment 74 to enable, for example, threading and unthreading of engagement region 70 and corresponding engagement region 72.

The shiftable power sleeve 52 can be shifted to a release position by applying an appropriate input downhole, such as a hydraulic pressure input. For example, if one or more of the upper communication lines 40 comprises a hydraulic communication line, the hydraulic communication line can be pressurized to move the shiftable power sleeve. In the example illustrated in FIG. 2, sufficient hydraulic pressure is applied through one of the upper communication lines 40 to break a rupture disk 76 otherwise blocking fluid flow to a chamber 78. As chamber 78 fills with pressurized fluid, shiftable power sleeve 52 is moved in an upward direction until extension 68 is withdrawn from its position between upper completion mandrel 48 and collet 50. Without the support of extension 68, collet 50 collapses inwardly when upper completion 34 is pulled in an upward direction. The upper completion 34 can then be retrieved to a surface location or other appropriate location. Prior to shifting the shiftable power sleeve 52 to the release position, the power sleeve 52 can be held in position by a shear member 80, e.g. a shear pin.

In the event there are no hydraulic communication lines or the hydraulic communication line providing flow to chamber 78 is blocked, a redundant hydraulic actuation system can be used to move shiftable power sleeve 52. In this example, upper completion 34 comprises a second rupture disk 82 deployed in a passage 84 extending between the internal passage 66 of upper completion 34 and chamber 78. Application of sufficient pressure along the completion interior, e.g. along internal passage 66, of upper completion 34 causes rupture disk 82 to break. The pressurized fluid is then able to flow through passage 84 to chamber 78 and move shiftable power sleeve 52 to the release position, thereby disengaging the upper completion 34 from the lower completion 32.

If the interior of upper completion 34 is hydraulically connected with the surrounding annulus, the ability to create a pressure differential for moving shiftable power sleeve 52 by applying pressure along passage 66 is not possible. Accordingly, upper completion 34 may further comprise an atmospheric chamber 86 that enables shifting of the shiftable power sleeve 52 to its release position by applying sufficient pressure along upper completion 34. The pressure can be applied along the interior of upper completion 34, along the exterior, e.g. surrounding annulus, of upper completion 34, or along both the interior and exterior of upper completion 34. This application of internal and external pressure creates a pressure differential with atmospheric chamber 86 and shifts power sleeve 52 to the release position. Further redundancy can be provided by constructing shiftable power sleeve 52, or at least a lower portion of shiftable power sleeve 52, from a material that is dissolvable over time when exposed to a specific well fluid.

Figure 3:
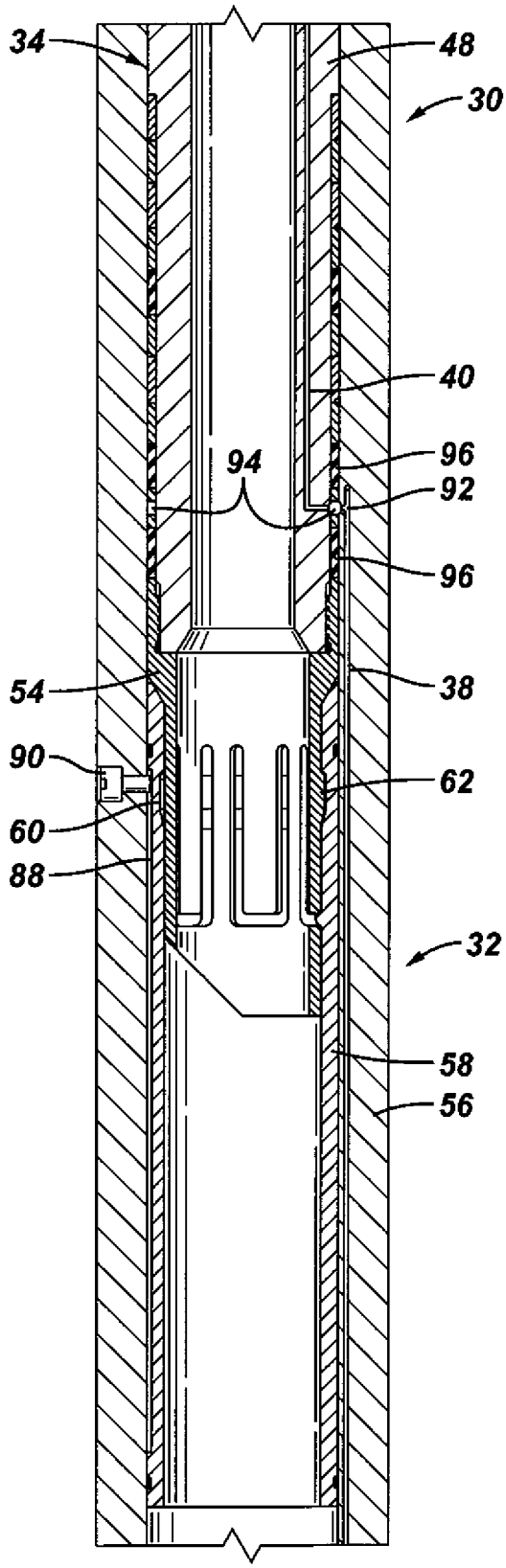
FIG. 3 is an enlarged view of another portion of the well system illustrated in FIG. 1, according to an embodiment of the present invention.

When upper completion 34 is moved upwardly, the secondary or lower collet 54 pulls lower protection sleeve 58 upwardly. As illustrated in FIG. 3, lower protection sleeve 58 comprises a slot 88 positioned to receive a stop, such as a limiter screw 90 extending inwardly from lower completion housing 56. The limiter screw 90 stops the upward movement of lower protection sleeve 58 so that lower collet 54 is forced to disengage from lower protection sleeve 58. When upward movement of the lower protection sleeve 58 is stopped, the lower protection sleeve is in a position to cover a side port 92 and block entry of foreign material along lower communication line 38. Although not shown, an upper protection sleeve that is similar to lower protection sleeve 58 can be installed on upper completion mandrel 48 to protect the upper communication line. The upper protection sleeve can be installed along the outside diameter of the upper completion mandrel 48 in a position to move over a side port of the upper communication line.

During disengagement and/or engagement of upper completion 34 with lower completion 32, a communication line union 94 operatively connects the upper communication line or lines 40 with the lower communication line or lines 38 regardless of the rotational orientation of the upper completion 34 relative to the lower completion 32. The union 94 may be designed to provide communication between upper communication line 40 and lower communication line 38 at a plurality of relative angles between the upper and lower completions. In the embodiment illustrated, the communication lines are operatively connected throughout 360° of angular displacement of the upper completion 34 relative to the lower completion 32. The union 94 may be an annular ring member in the form of a hydraulic channel or physical signal conductor able to transmit signals between upper and lower communication lines. By way of example, union 94 may comprise a concentric union deployed circumferentially around upper completion mandrel 48 at a location that positions union 94 proximate side port 92 when the upper and lower completions are fully engaged.

By way of further example, union 94 may comprise an annular hydraulic channel for use with hydraulic communication lines. In addition or alternatively, the union 94 may comprise an annular conductive member for connecting electrical lines. The conductive member comprises, for example, a pair of contact rings, a ring and a brush, an inductive coupler, or other suitable conductive elements that extend around the circumference of the upper completion mandrel. Similarly, an optical signal connector also can be constructed to provide an annular connection for transmitting optical signals. In FIG. 3, union 94 is illustrated as an annular member representative of a hydraulic, electrical, and/or optical signal transmission medium that enables coupling of the communication lines regardless of the rotational alignment between upper completion 34 and lower completion 32. Appropriate seal elements 96 can be provided above and below union 94 to seal the union 94 and prevent unwanted ingress or egress of fluids.

Figure 4:
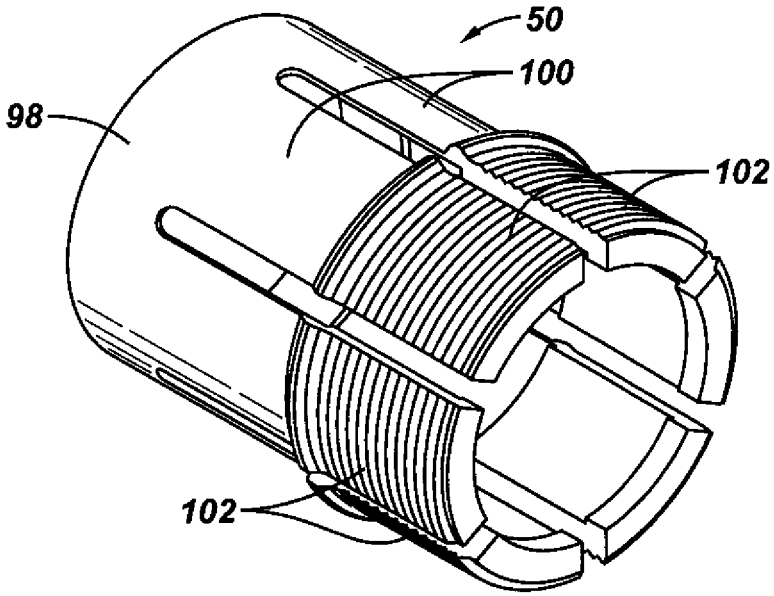
FIG. 4 is an orthogonal view of an embodiment of a collet utilized in selectively coupling the upper completion assembly to the lower completion assembly, according to an embodiment of the present invention.

One embodiment of collet 50 is illustrated in FIG. 4. In this embodiment, collet 50 comprises a base region 98 and a plurality of flexible fingers 100 extending in an axial direction from base region 98. The flexible fingers 100 have threaded ends 102 that form a threaded region for engagement with lower completion 32. In this example, engagement region 70 (see FIG. 2) is a threaded engagement region that may be threadably engaged with corresponding engagement region 72, also threaded. However, once shiftable power sleeve 52 is moved to the release position, flexible fingers 100 are flexed inwardly under a sufficient upward pull on upper completion 34. Accordingly, the threaded engagement can be disengaged without relative rotation of the completion assemblies.

Figure 5:
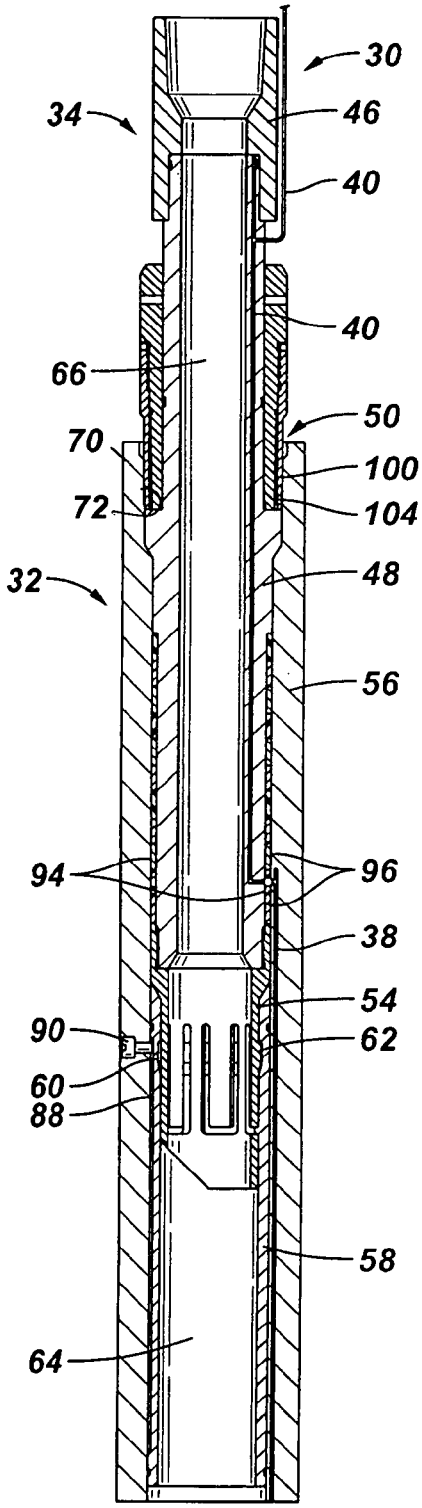
FIG. 5 is a front elevation view of a well system having an upper completion assembly and a lower completion assembly deployed in a wellbore, according to an alternate embodiment of the present invention.

When a two-trip approach is used, the connection between upper completion 34 and lower completion 32 need not be as robust because the connection need not take the load of the lower completion during deployment. One embodiment of a well system 30 designed for deployment of completions in a two-step approach is illustrated in FIG. 5. The two-trip well system is very similar to that illustrated and described with respect to FIGS. 1-4, however the structure of the connection between the upper and lower completions is simpler.

Figure 6:
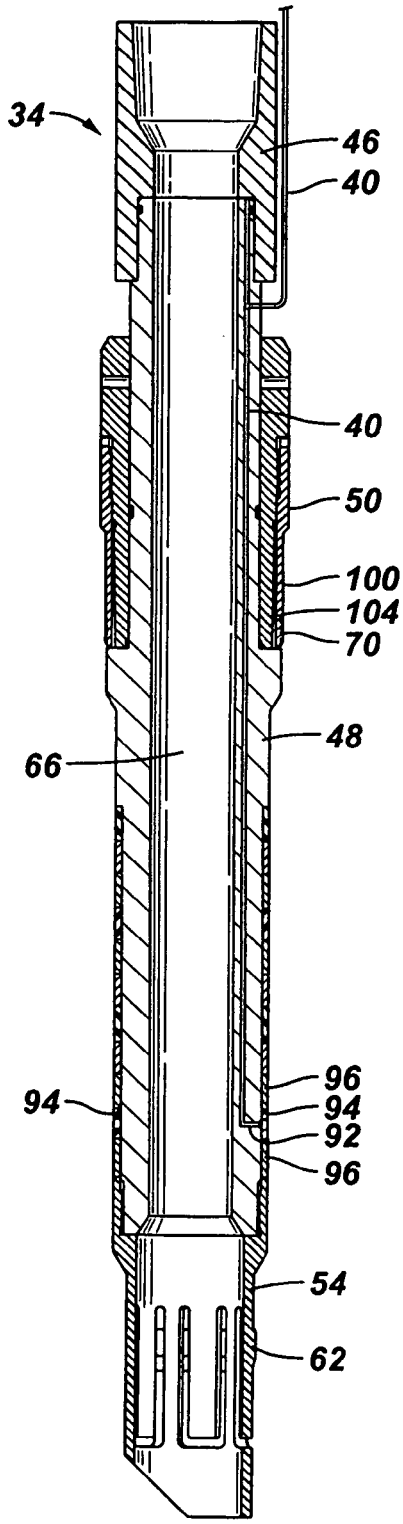
FIG. 6 is a view of the upper completion assembly illustrated in the well system of FIG. 5, according to an embodiment of the present invention.

With additional reference to FIG. 6, the connection between upper completion 34 and lower completion 32 can once again be formed with a collet, e.g. collet 50 illustrated in FIG. 4. However, the shiftable power sleeve 52 is not required to lock engagement region 70 against corresponding engagement region 72 of the lower completion 32. Instead, a space 104 is left between the flexible collet fingers 100 and the underlying upper completion mandrel 48. When the upper completion 34 is engaged with the lower completion 32, the upper completion is pushed downwardly until collet 50 is sufficiently deformed to connect engagement region 70 with corresponding engagement region 72. The upper completion 34 can be disengaged from lower completion 32 simply by providing a sufficient upward pull on upper completion 34 to deform collet 50 so that it releases from the lower completion assembly. It should be noted that the type of upper completion assembly illustrated in FIG. 6 is readily usable with the lower completion assembly deployed in a one-trip approach after the original upper completion has been disengaged and pulled from the wellbore.

Figure 7:
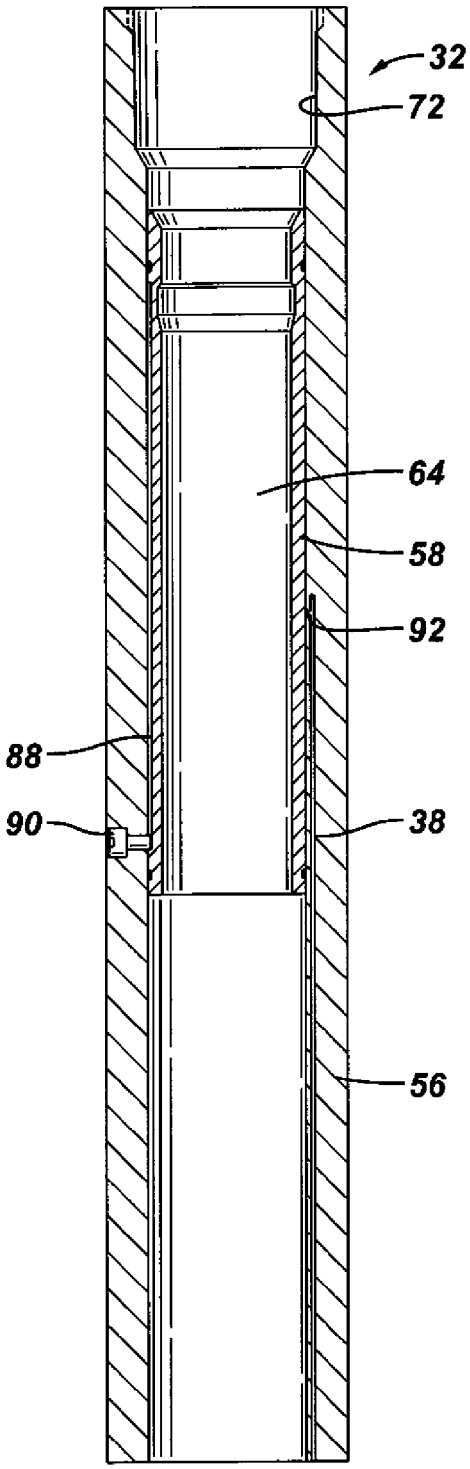
FIG. 7 is view of the lower completion assembly illustrated in the well system of FIG. 5, according to an embodiment of the present invention.

As in the one-trip embodiment, the upper completion 34 used in a two-trip approach also may comprise secondary collet 54 used to lift lower protection sleeve 58, as illustrated in FIG. 7. When the upper completion is disengaged from the lower completion and pulled upwardly, lower protection sleeve 58 moves upwardly with secondary collet 54 until stopped by limiter screw 90 or other appropriate stop mechanism. As illustrated, the lower protection sleeve 58 blocks access to side port 92. It should be noted that if a protection sleeve is used on the upper completion 34 to block access to a hydraulic communication line, an appropriate rupture disk or disks can be placed in the hydraulic communication line to prevent high-speed discharge of hydraulic fluid when the protection sleeve is shifted during engagement of the upper completion and lower completion. Once the completion assemblies are engaged, such a rupture disk can be broken by applying sufficient pressure from a surface location.

Figure 8:
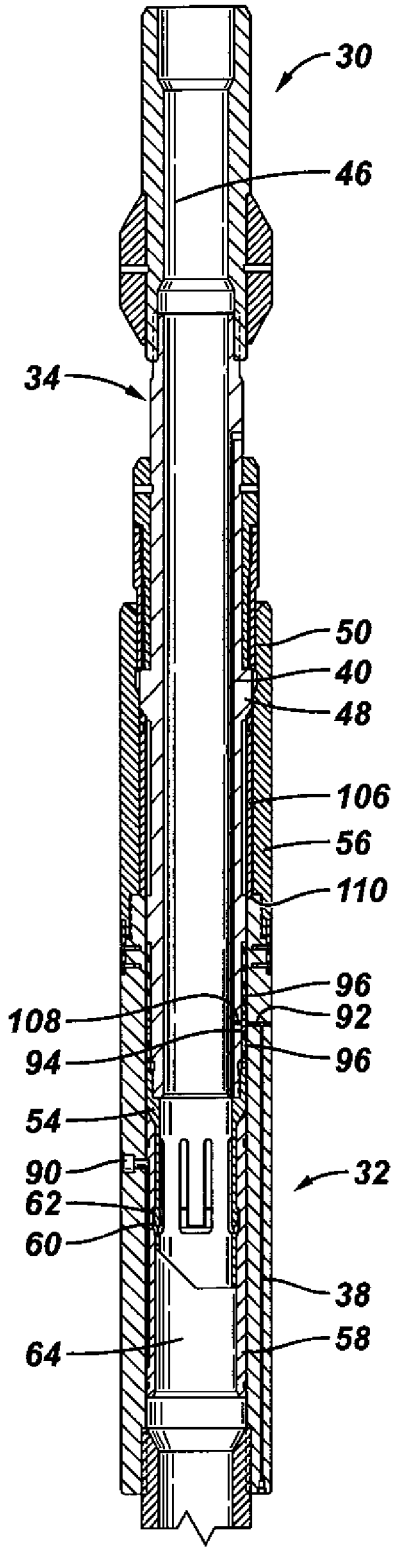
FIG. 8 is a cross-sectional view of a well system having an upper completion assembly and a lower completion assembly, according to an alternate embodiment of the present invention.

In an alternate embodiment, an upper protection sleeve 106 is slidably mounted along the exterior of upper completion mandrel 48, as illustrated in FIG. 8. The upper protection sleeve 106 can be positioned to cover a port 108 of upper communication line 40 when upper completion 34 and lower completion 32 are not engaged. Upper protection sleeve 106 protects the upper communication line 40 from exposure to the wellbore environment, similar to the manner in which lower protection sleeve 58 protects lower communication line 38 from exposure to the wellbore environment. By way of example, upper protection sleeve 106 can be used to cover port 108 prior to engagement of upper completion 34 with lower completion 32. However, as the upper completion 34 engages lower completion 32, upper protection sleeve 106 is slid along seals 96 and upper completion mandrel 48 to expose port 108 and enable communicative engagement of the upper and lower communication lines. In the example illustrated, upper protection sleeve 106 is moved by a shoulder 110 within lower completion housing 56. Upper protection sleeve 106 and lower protection sleeve 58 can be used individually or in combination, depending on the specific design requirements of well system 30.

The embodiments described above provide examples of well systems that facilitate engagement and disengagement of completion assemblies used in a well environment. However, the size, shape, and configuration of the various components can be adjusted according to the specific application and the number of downhole trips used for a given job. Various components can be arranged differently, and additional components can be incorporated into the design. For example, the connection between the upper and lower completions can be formed by collets or other suitable mechanisms. Additionally, the collet can be mounted on the upper completion or the lower completion. If a threaded collet is utilized, the threaded region can be positioned to engage a threaded region on either the lower completion or the upper completion. Additionally, the number, type and arrangement of communication lines can be selected according to the specific well applications for which the system is designed.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A completion system, comprising:

a lower completion having a lower communication line;

an upper completion having an upper communication line;

a latch mechanism positioned to enable selective mechanical engagement and disengagement of the upper completion with the lower completion while located in a wellbore; and a concentric union to enable connection of the upper communication line with the lower communication line at a range of rotational orientations of the upper completion relative to the lower completion.

2. The completion system as recited in claim 1, wherein the concentric union comprises an annular ring member.

3. The completion system as recited in claim 2, wherein the annular ring member comprises an annular hydraulic passage for connecting hydraulic communication lines.

4. The completion system as recited in claim 2, wherein the annular ring member comprises a conductive member for connecting electrical communication lines.

5. The completion system as recited in claim 2, wherein the annular ring member comprises an optical member for connecting optical communication lines.

6. The completion system as recited in claim 1, wherein the latch mechanism comprises a snap latch collet with a plurality of fingers having threads to form a threaded engagement between the upper completion and the lower completion.

7. The completion system as recited in claim 6, further comprising a shiftable power sleeve positioned to prevent disruption of the threaded engagement when in a locked position and to permit release of the threaded engagement when shifted to a release position.

8. The completion system as recited in claim 7, wherein the shiftable power sleeve is shifted from the locked position to the release position by applying pressure through a hydraulic communication line.

9. The completion system as recited in claim 7, wherein the shiftable power sleeve is shifted from the locked position to the release position by applying pressure along an interior of the upper completion.

10. A method, comprising:

moving an upper completion into engagement with a lower completion positioned in a wellbore;

latching the upper completion with the lower completion; and joining an upper communication line of the upper completion with a lower communication line of the lower completion via a union able to operationally join the upper communication line and the lower communication line regardless of the rotational orientation of the upper completion relative to the lower completion.

11. The method as recited in claim 10, further comprising selectively disengaging the upper completion from the lower completion and the upper communication line from the lower communication line.

12. The method as recited in claim 11, further comprising pulling a lower protection sleeve into a position to block flow into the lower communication line when the upper completion is disengaged from the lower completion.

13. The method as recited in claim 11, further comprising moving an upper protection sleeve into a position to block exposure of the upper communication line when the upper completion is not engaged with the lower completion.

14. The method as recited in claim 10, wherein latching comprises latching the upper completion to the lower completion with a snap latch collet.

15. The method as recited in claim 10, wherein latching comprises utilizing a snap latch collet with a plurality of flexible fingers having a threaded region for threaded engagement with a corresponding threaded region of the lower completion.

16. The method as recited in claim 10, wherein joining comprises joining the upper communication line with the lower communication line via a concentric union.

17. A system, comprising:

a lower completion having a lower communication line;

an upper completion having an upper communication line;

a flexible mechanism to selectively mechanically engage the upper completion with the lower completion;

a shiftable power sleeve movable to a locked position in which the flexible mechanism is held in a position to maintain engagement of the upper completion and the lower completion;

a union to automatically connect and disconnect the upper communication line with the lower communication line during engagement and disengagement of the upper completion with the lower completion, respectively; and a lower protection sleeve and an upper protection sleeve positioned to block exposure of the lower communication line and the upper communication line, respectively, to the wellbore environment while the upper completion is not engaged with the lower completion.

18. The system as recited in claim 17, wherein the flexible mechanism comprises a snap latch collet.

19. The system as recited in claim 17, further comprising a lower collet and a protection sleeve, wherein upon disengagement of the upper completion from the lower completion, the lower collet moves the protection sleeve to block access to at least one of the communication lines.

20. The system as recited in claim 17, wherein the shiftable power sleeve is movable to a release position by application of hydraulic pressure downhole.

21. A method of enabling repeatable engagement and disengagement of upper and lower completions, comprising:

selectively engaging an upper completion and a lower completion with a collet;

engaging an upper communication line of the upper completion with a lower communication line of the lower completion regardless of the rotational orientation of the upper completion relative to the lower completion.

22. The method as recited in claim 21, wherein selectively engaging comprises engaging at least one of the lower completion and the upper completion with a plurality of collet fingers having a threaded region.

23. The method as recited in claim 22, further comprising selectively holding the threaded region to a corresponding threaded region of the lower completion with a shiftable power sleeve that may be shifted between a locked position and a release position.

24. The method as recited in claim 21, further comprising positioning a lower protection sleeve and an upper protection sleeve to block exposure of the lower communication line and the upper communication line, respectively, to the wellbore environment while the upper completion is not engaged with the lower completion.

* * * * *